US008056742B2

(12) United States Patent
Brozell et al.

(10) Patent No.: US 8,056,742 B2
(45) Date of Patent: Nov. 15, 2011

(54) TWO-PIECE CHILD-RESISTANT CLOSURE AND PACKAGE

(75) Inventors: Brian J. Brozell, Maumee, OH (US); Philip J. Robinson, Sylvania, OH (US)

(73) Assignee: Rexam Healthcare Packaging Inc., Perrysburg, OH (US)

( * ) Notice: Subject to any disclaimer, the term of this patent is extended or adjusted under 35 U.S.C. 154(b) by 1141 days.

(21) Appl. No.: 11/888,106

(22) Filed: Jul. 31, 2007

(65) Prior Publication Data

US 2009/0032486 A1 Feb. 5, 2009

(51) Int. Cl.
*B65D 55/02* (2006.01)

(52) U.S. Cl. ..... 215/220

(58) Field of Classification Search ..... 215/217, 215/219, 220, 221; 220/274, 284
See application file for complete search history.

(56) References Cited

U.S. PATENT DOCUMENTS

| | | | | |
|---|---|---|---|---|
| 3,394,829 | A | 7/1968 | Peterson | |
| 3,756,444 | A * | 9/1973 | McIntosh | 215/220 |
| 3,776,407 | A | 12/1973 | Cistone | |
| 3,857,505 | A | 12/1974 | Mumford et al. | |
| 4,319,690 | A | 3/1982 | Birrell et al. | |
| 4,385,705 | A | 5/1983 | Kusz | |
| 4,598,833 | A | 7/1986 | Herr | |
| 4,609,114 | A | 9/1986 | Roy | |
| 4,632,264 | A | 12/1986 | Evans | |
| 4,801,028 | A * | 1/1989 | Puresevic et al. | 215/220 |
| 4,854,459 | A | 8/1989 | DeJonge | |
| 4,997,096 | A | 3/1991 | Kusz | |
| 5,188,251 | A | 2/1993 | Kusz | |
| 5,280,842 | A | 1/1994 | Koo | |
| 5,445,283 | A | 8/1995 | Krautkramer | |
| 6,202,869 | B1 | 3/2001 | Sullivan | |
| 6,206,216 | B1 | 3/2001 | Stalions | |
| 6,688,484 | B2 * | 2/2004 | Boulange et al. | 220/284 |
| 7,000,789 | B2 | 2/2006 | Miceli et al. | |

(Continued)

FOREIGN PATENT DOCUMENTS

| | | |
|---|---|---|
| AU | 9879927 | 1/2000 |

(Continued)

OTHER PUBLICATIONS

Annotated figure from US Pat. No. 4,801,028.*

*Primary Examiner* — Anthony Stashick
*Assistant Examiner* — James N Smalley
(74) *Attorney, Agent, or Firm* — Reising Ethington PC

(57) ABSTRACT

A child-resistant closure includes a plastic inner shell having a base wall with a peripheral skirt, at least one internal thread segment on the peripheral skirt and a plurality of internal lugs on the base wall adjacent to the skirt. A plastic outer shell has a base wall with a peripheral skirt and a plurality of internal L-shaped lugs at a juncture of the base wall and the peripheral skirt. Each of the L-shaped lugs includes a first portion extending radially inwardly along an undersurface of the base wall of the outer shell for engaging the external lugs on the inner shell, and a second portion extending axially along an inner surface of the peripheral skirt of the outer shell for slidably engaging the inner shell and aligning the inner shell within the outer shell. The second portions of the L-shaped lugs preferably have rounded radially inwardly facing surfaces for reduced sliding friction with the skirt of the inner shell.

9 Claims, 5 Drawing Sheets

U.S. PATENT DOCUMENTS

| | | | |
|---|---|---|---|
| 7,111,746 | B2 | 9/2006 | Miceli et al. |
| 2004/0262251 | A1 | 12/2004 | Tauber |
| 2006/0108313 | A1 | 5/2006 | Brozell et al. |
| 2007/0045319 | A1 | 3/2007 | Hogan |
| 2007/0045320 | A1 | 3/2007 | Biesecker et al. |

FOREIGN PATENT DOCUMENTS

| | | | |
|---|---|---|---|
| EP | 000090143 | A1 | 10/1983 |
| GB | 1529999 | | 12/1976 |

* cited by examiner

TWO-PIECE CHILD-RESISTANT CLOSURE AND PACKAGE

The present disclosure relates to two-piece push-and-turn child-resistant closures, and to packages that include such closures.

BACKGROUND AND SUMMARY OF THE DISCLOSURE

U.S. Pat. No. 4,997,096 discloses a child-resistant closure having inner and outer plastic shells. The outer plastic shell has a base wall, a peripheral skirt and a circumferential array of lugs on an undersurface of the base wall. The inner plastic shell has a base wall, a peripheral skirt, at least one internal thread segment on the skirt, and a circumferential array of lugs on an outer surface of the base wall for opposed engagement by the internal lugs on the base wall of the outer shell. To remove the closure when it is threaded onto a container neck finish, the outer shell must be pushed axially against the inner shell and simultaneously rotated so that the lugs on the outer shell engage the lugs on the inner shell and rotate the inner shell with respect to the container neck finish. When the outer shell is rotated without applying an axial force to the outer shell, the lugs on the outer shell simply cam over the lugs on the inner shell and do not rotate the inner shell with respect to the container neck finish. Child-resistant closures of this type have been marketed for many years by applicants' assignee under the trademark ARGUS-LOC. See also GB 1529999. A general object of the present disclosure is to provide improvements in child-resistant closures of this type, and to provide packages that include such improved closures.

The present disclosure embodies a number of aspects that can be implemented separately from or in combination with each other.

A child-resistant closure in accordance with one aspect of the present disclosure includes a plastic inner shell having a base wall with a peripheral skirt, at least one internal thread segment on the peripheral skirt and a plurality of internal lugs on the base wall adjacent to the skirt. A plastic outer shell has a base wall with a peripheral skirt and a plurality of internal L-shaped lugs at a juncture of the base wall and the peripheral skirt. Each of the L-shaped lugs includes a first portion extending radially inwardly along an undersurface of the base wall of the outer shell for engaging the external lugs on the inner shell, and a second portion extending axially along an inner surface of the peripheral skirt of the outer shell for slidably engaging the inner shell and aligning the inner shell within the outer shell. The second portions of the L-shaped lugs preferably have rounded radially inwardly facing surfaces for reduced sliding friction with the skirt of the inner shell.

A child-resistant closure in accordance with another aspect of the present disclosure includes a plastic inner shell having a base wall, a peripheral skirt with at least one internal thread segment and an angularly spaced circumferential array of external lugs on the base wall. A plastic outer shell has a base wall, a peripheral skirt and an angularly spaced circumferential array of internal lugs on the base wall. The inner plastic shell is received within the outer plastic shell such that the internal lugs on the base wall of the outer plastic shell are disposed for engagement with the external lugs on the base wall of the inner plastic shell to apply or remove the closure to or from a container neck finish. The internal lugs on the outer shell and the external lugs on the inner shell have opposed rounded axially facing surfaces such that the internal lugs on the outer shell cannot rest on the external lugs of the inner shell upon application of force to the outer shell.

A child-resistant closure in accordance with a further aspect of the present disclosure includes a plastic outer shell having a base wall with a peripheral skirt and a plurality of internal lugs on the base wall adjacent to the skirt, and a plastic inner shell disposed within the outer shell and having a base wall with a peripheral skirt, at least one internal thread segment on the peripheral skirt and a plurality of external lugs on the base wall adjacent to the skirt. The base wall of the outer shell has a peripheral portion of a first thickness on which the internal lugs are disposed and an imperforate central portion of a second thickness less than the first thickness. The base wall of the inner shell has a peripheral portion of a third thickness on which the external lugs are disposed and an imperforate central portion of a fourth thickness less than the first thickness. The thinner central portions of the inner and outer shell reduce the weight and cost of the closure.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
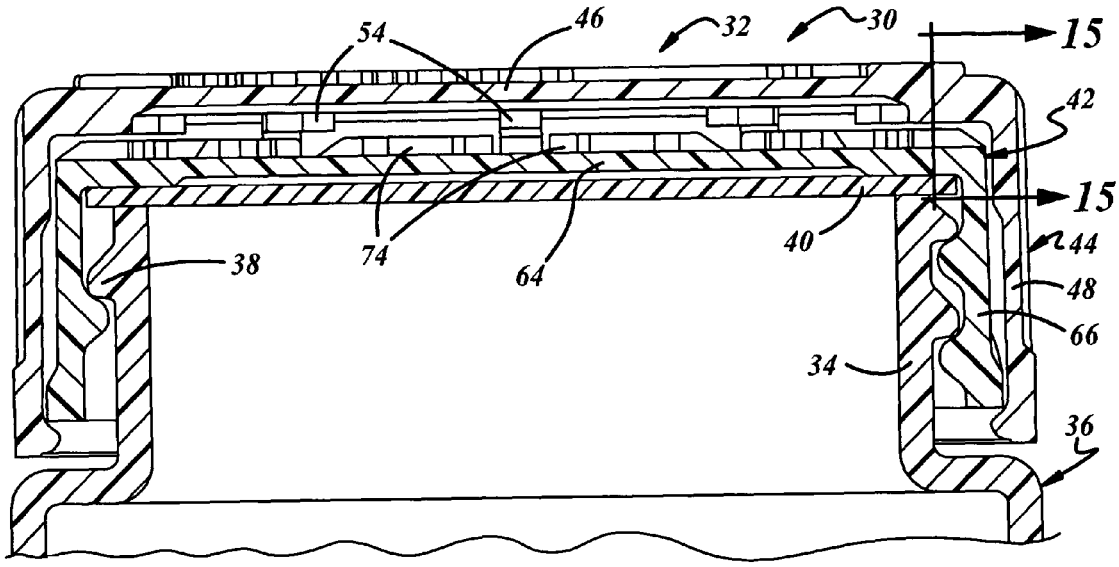
FIG. 1 is a fragmentary sectional view of a child-resistant package in accordance with an exemplary embodiment of the present disclosure.
Figure 2:
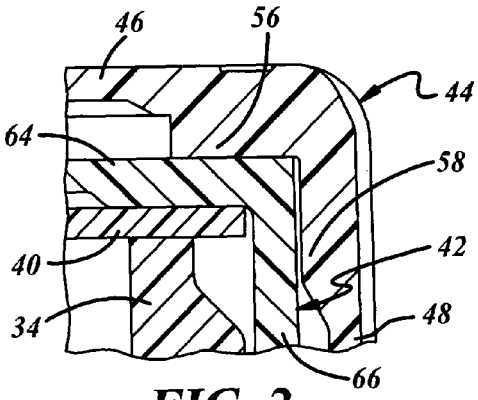
FIGS. 2 and 3 are sectional views taken at angularly spaced locations in the package of FIG. 1.
Figure 3:
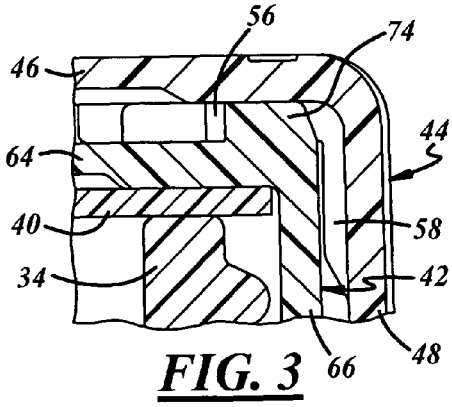

FIGS. 1-3 illustrate a child-resistant package 30 in accordance with an exemplary embodiment of the present disclosure as including a child-resistant closure 32 applied to the neck finish 34 of a container 36. Container 36 can be of glass or plastic construction. Neck finish 34 is cylindrical and includes at least one external thread segment 38 to which closure 32 is applied. (The term "thread segment" is employed in its usual broad sense in this disclosure as including both single and multiple threads, and both continuous and discontinuous threads.) A foil seal 40 can be applied to the end surface of neck finish 34 both to seal the package during shipment and handling, and to provide indication that the package has not been opened.

Figure 4:
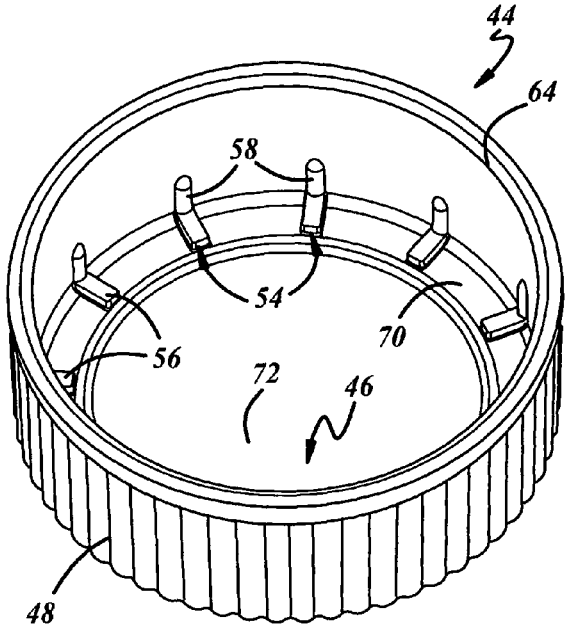
FIG. 4 is a perspective view of the plastic outer shell in the closure of the package in FIGS. 1-3.
Figure 5:
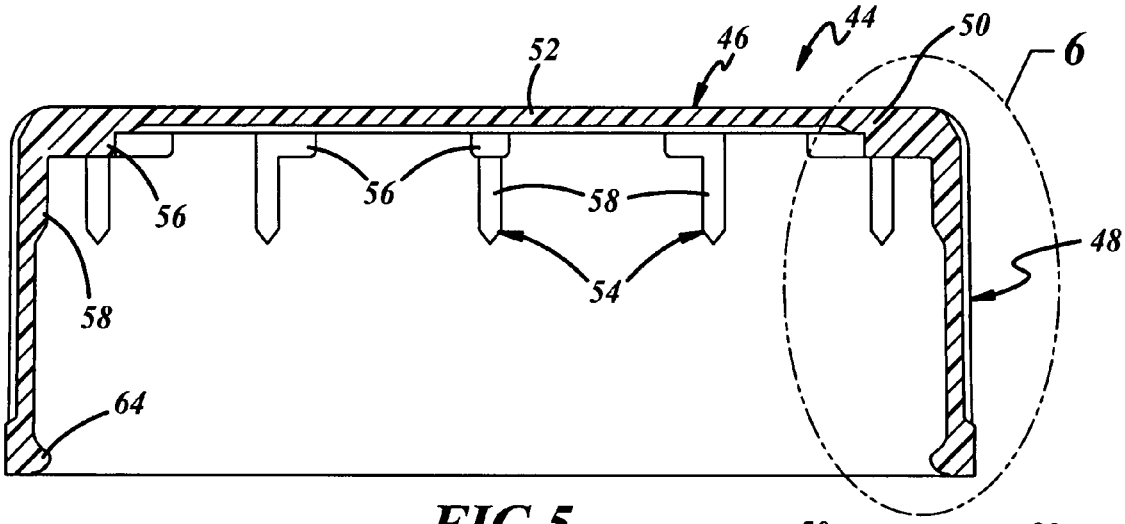
FIG. 5 is a sectional view of the plastic outer shell in FIG. 4.
Figure 6:
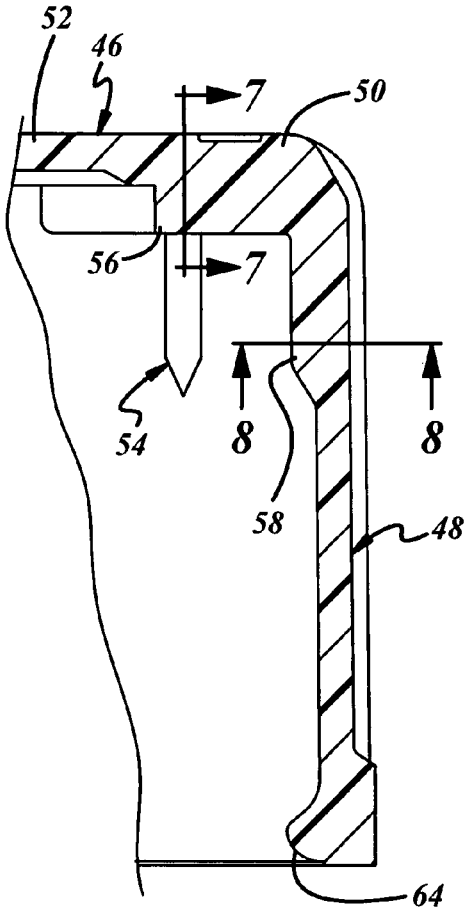
FIG. 6 is a fragmentary sectional view on an enlarged scale of the portion of FIG. 5 within the area 6.
Figure 7:
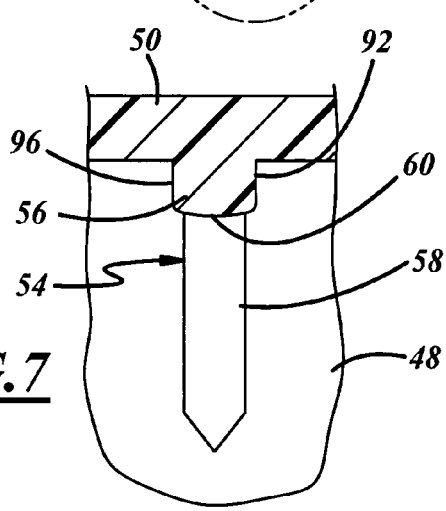
FIGS. 7 and 8 are fragmentary sectional views taken substantially along the respective lines 7-7 and 8-8 in FIG. 6.
Figure 8:
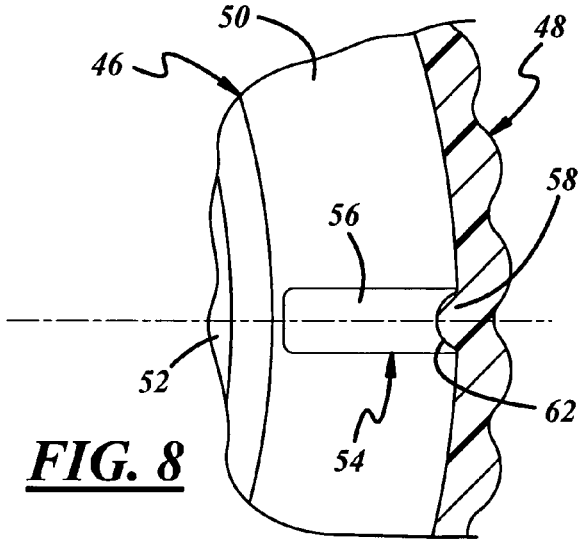
Figure 9:
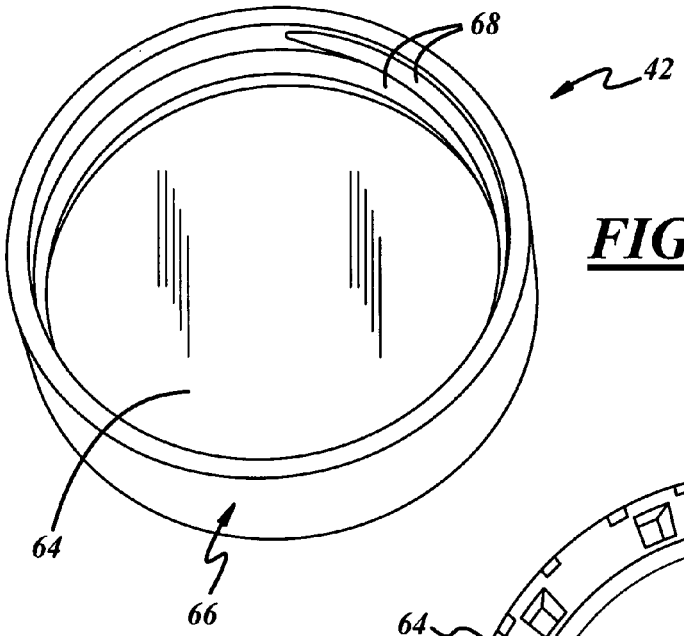
FIG. 9 is a perspective view of the plastic inner shell of the closure in the package of FIGS. 1-3.
Figure 10:
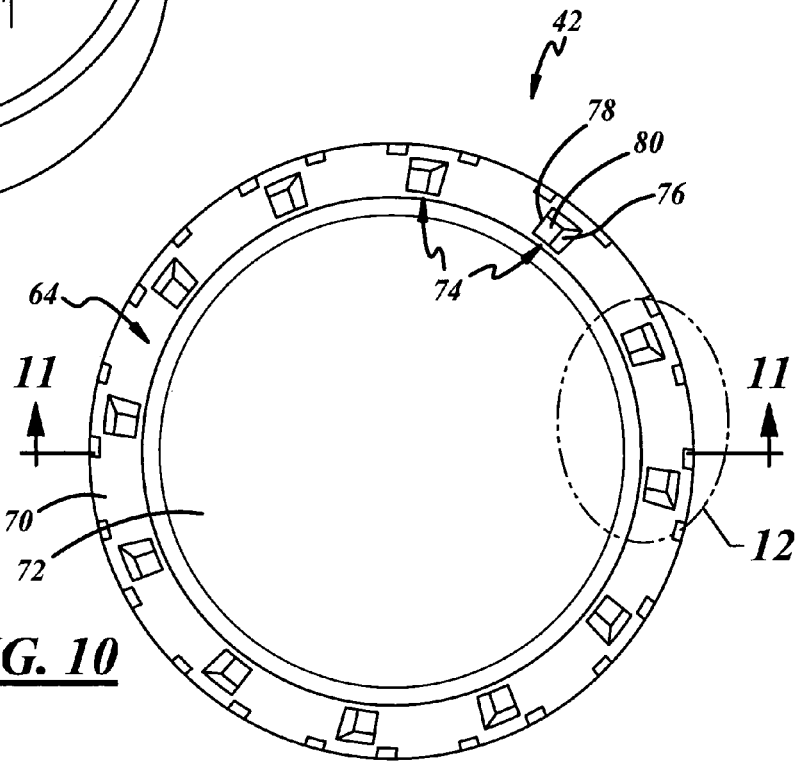
FIG. 10 is a plan view of the plastic inner shell in FIG. 9.
Figure 11:
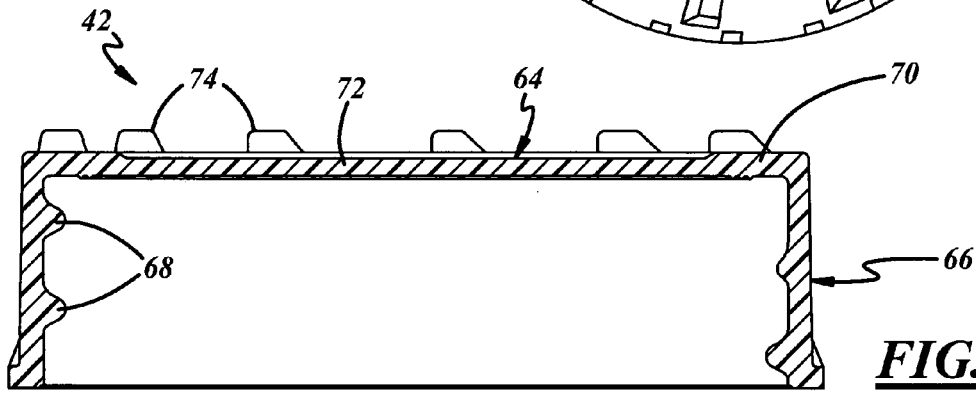
FIG. 11 is a sectional view taken substantially along the line 11-11 in FIG. 10.
Figure 12:
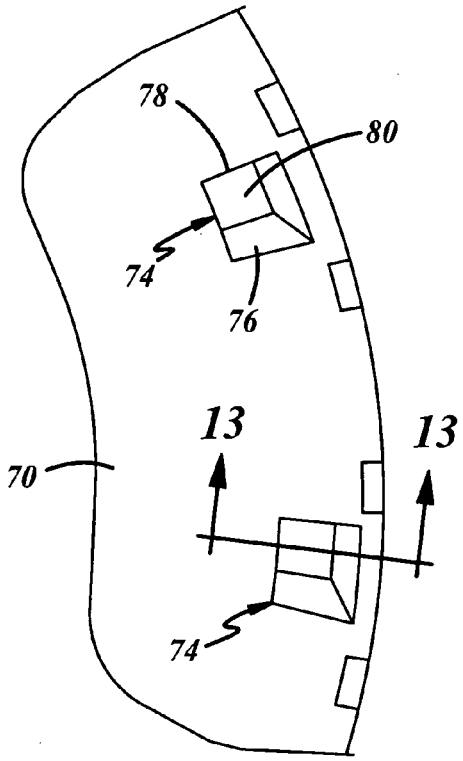
FIG. 12 is a plan view on an enlarged scale of the portion of FIG. 10 within the area 12.

Child-resistant closure 32 includes a plastic inner shell 42 captured within a plastic outer shell 44. Outer shell 44 is illustrated in FIGS. 4-8 as including a base wall 46 and a cylindrical peripheral skirt 48. Base wall 46 preferably includes a peripheral portion 50 of a first thickness and a central portion 52 of a second thickness less than the first thickness of peripheral portion 50. Central portion 52 of outer shell 44 preferably is imperforate as shown in FIGS. 4 and 5, although central portion 52 could be open in accordance with some aspects of the present disclosure. Indicia can be provided on the outer surface of central portion 52 to instruct a user how to open the package. A plurality of angularly spaced internal lugs 54 are disposed on base wall 46 adjacent to skirt 48. Each lug 54 preferably is L-shaped, having a first portion or leg 56 that extends radially inwardly along the undersurface of base wall 46, and a second portion or leg 58 that extends axially downwardly along the inside surface of skirt 48. The undersurfaces 60 of lug portions 56 preferably are rounded as best seen in FIG. 7, as are the radially inwardly facing surfaces 62 of lug portions 58 as best seen in FIG. 8. There preferably is an internal bead 64 adjacent to the edge of skirt 48 remote from base wall 46 for capturing inner shell 42 within outer shell 44.

Figure 13:
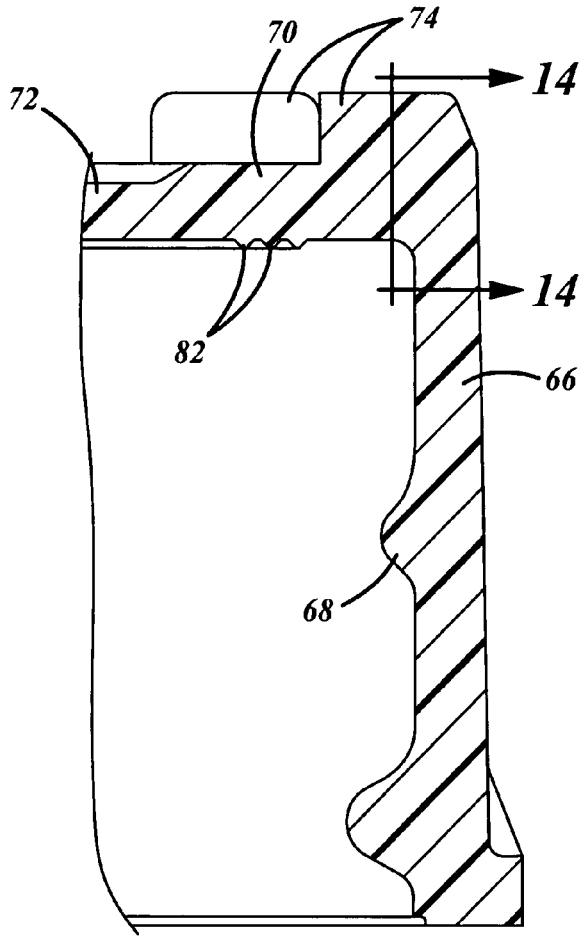
FIG. 13 is a fragmentary sectional view taken substantially along the line 13-13 in FIG. 12.
Figure 14:
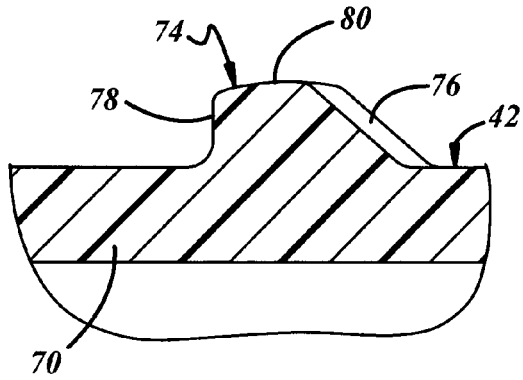
FIG. 14 is a fragmentary sectional view taken substantially along the line 14-14 in FIG. 13.

Inner shell 42 is illustrated in FIGS. 9-13 as including a base wall 64 and a cylindrical peripheral skirt 66. Peripheral skirt 66 has one or more internal thread segments 68 for securing the closure to external thread segments 38 on container neck finish 34 (FIG. 1). Base wall 64 preferably has a peripheral portion 70 of a third thickness, and an imperforate central portion 72 of a fourth thickness less than the third thickness of peripheral portion 70. A circumferential array of angularly spaced external lugs 74 are disposed around the periphery of base wall 64 adjacent to skirt 66. Each lug 74 has a clockwise-facing cam face 76 and a counterclockwise-facing abutment face 78. The upper or axially oriented faces 80 of lugs 74 preferably are rounded, as best seen in FIG. 14. V-seals 82 can be provided on the undersurface of base wall peripheral portion 70, as best seen in FIG. 13, for sealing engagement with the end surface of container neck finish 34 (FIG. 1) after removal of foil seal 40.

Figure 16:
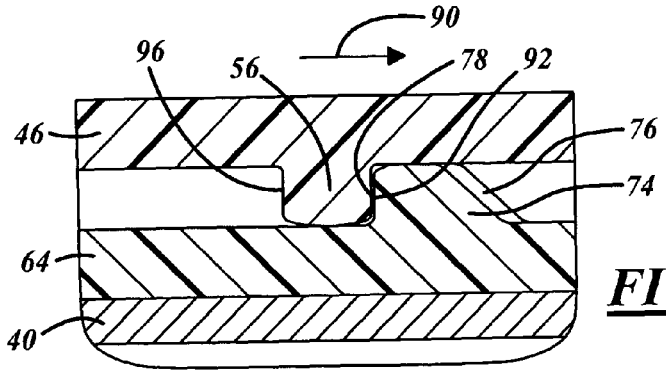
FIG. 16 is a fragmentary sectional view that illustrates the lugs of FIG. 15 in engagement for applying the closure to the container neck finish, being taken substantially along the line 16-16 in FIG. 18.
Figure 17:
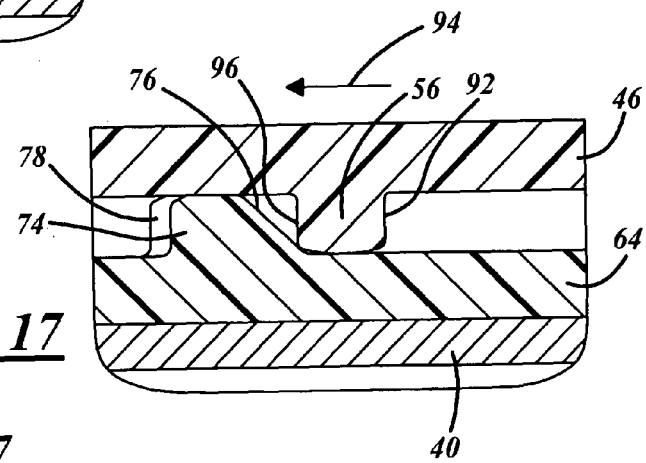
FIG. 17 is a fragmentary sectional view similar to that of FIG. 16 but showing the lugs disposed for removing the closure from the container neck finish, being taken substantially along the line 17-17 in FIG. 18.

Inner shell 42 preferably is captured within outer shell 44 by bead 64 on the outer shell. To apply the closure to container neck finish 34, outer shell 44 is pushed downwardly and rotated clockwise so that lug portions 56 on the outer shell are brought into engagement with abutment faces 78 of lugs 74 on the inner shell, as shown in FIG. 16. Application of a clockwise force to the outer shell threads the inner shell onto the container neck finish. To remove the closure from the container neck finish, an axial force is applied to outer shell 44 and the outer shell is rotated counterclockwise to bring lug portions 56 on the outer shell into engagement with cam faces 76 on lugs 74 of the inner shell, as shown in FIG. 17. If insufficient axial force is applied to the outer shell, lug portions 56 will simply ride over cam faces 76 so that the inner shell will not rotate. However, if sufficient axial force is applied to the outer plastic shell, lug portions 56 will remain engaged with lugs 74 as shown in FIG. 17 and rotate the inner shell so as to remove the closure from the container neck finish.

Figure 15:
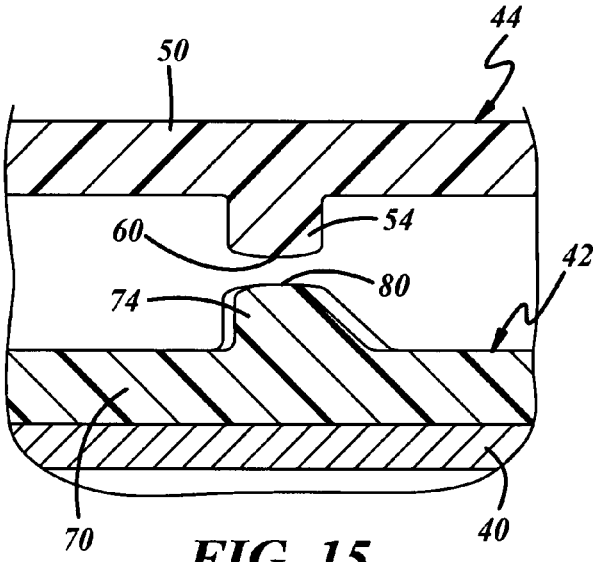
FIG. 15 is a fragmentary sectional view taken substantially along the line 15-15 in FIG. 1.

The axially facing surfaces 60,80 of lug portions 56 on the outer shell and lugs 74 on the inner shell preferably are rounded as previously described. In the event that the lugs are in axial alignment as illustrated in FIG. 15 when force is applied to the outer plastic shell, the opposed rounded surfaces 60,80 are such that the shells are not in a stable position with the lugs in axial abutment. Rather, lug portions 56 on the outer shell will move either clockwise or counterclockwise with respect to lugs 74 on the inner shell, due to the rounded geometries of the opposed lug faces, upon application of even minimal force in the clockwise or counterclockwise direction. This prevents the lugs from hanging up in opposed axial abutment, and makes application and removal of the closure easier for the user.

Figure 18:
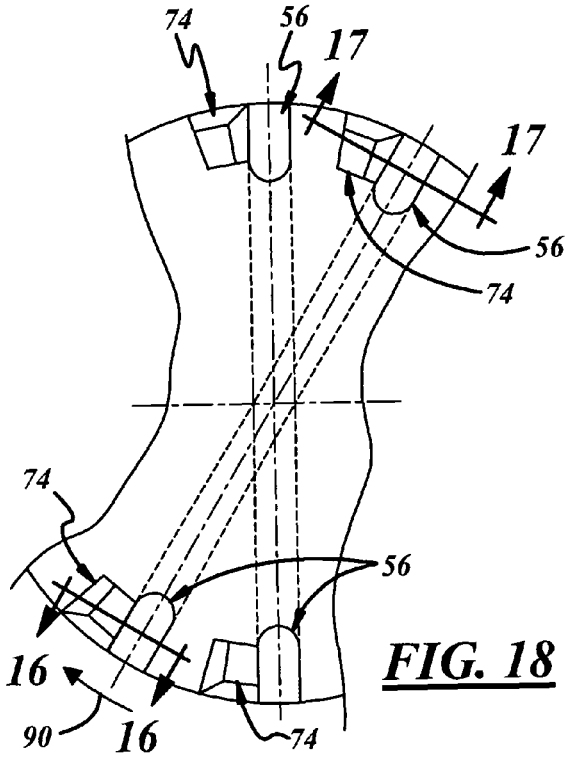
FIG. 18 is a schematic diagram of lug engagement for applying or removing the closure from the container neck finish.

The abutment faces of lug portions 56 on outer shell 44 and lugs 74 on inner shell 42 preferably are as illustrated in FIG. 18 so that there is line or surface contact rather than point contact between the opposing faces of the lugs in either the clockwise (application) or counterclockwise (removal) direction of rotation of the outer shell with respect to the inner shell. Thus, as shown in FIG. 18, the abutment faces of the lugs preferably are non-aligned with the central axis 84 of the closure. During application in the direction 90 (FIGS. 16 and 18), the clockwise-facing abutment face 92 of lug portion 56 is in line or surface contact with the counterclockwise-facing abutment face 78 of lug 74. During removal in the direction 94 (FIGS. 17 and 18), counterclockwise-facing abutment face 96 on lug portion 56 is in line contact with cam face 76 on lug 74.

Portions or legs 58 of L-shaped internal lugs 54 on outer shell 44, which extend axially along the inner surface of outer shell skirt 48, function slidably to engage the outer surface of skirt 66 on inner shell 42 and align the inner shell within the outer shell. The radially inwardly facing surfaces 62 of portions or legs 58 preferably are rounded, as best seen in FIG. 8, to reduce sliding friction between the inner and outer shells.

Provision of shell central portions 52,72 of reduced thickness as compared with respective peripheral portions 50,70 reduces the weight and cost of the respective shells without affecting the strength of the shells because most or all of the forces are applied through the peripheral portions of the respective shells during application and removal of the closure with respect to a container neck finish.

There thus has been disclosed a closure and a package that fully satisfy all of the objects and aims previously set forth. The disclosure has been presented in conjunction with an exemplary embodiment, and a number of modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A child-resistant closure that includes:

a plastic inner shell having a base wall with a peripheral skirt, at least one internal thread segment on said peripheral skirt and a plurality of external lugs on said base wall adjacent to said skirt, and a plastic outer shell having a base wall with a peripheral skirt and a plurality of internal L-shaped lugs at a juncture of said base wall and said peripheral skirt, each of said L-shaped lugs including a first portion extending radially inwardly along an undersurface of said base wall of said outer shell for engaging said external lugs on said inner shell, and a second portion extending axially along an inner surface of said peripheral skirt of said outer shell for slidably engaging said inner shell and aligning said inner shell within said outer shell, wherein said base wall of said outer shell has a peripheral portion of a first thickness on which said first portions of said internal lugs are disposed and an imperforate central portion of a second thickness less than said first thickness, and wherein said base wall of said inner shell has a peripheral portion of a third thickness on which said external lugs are disposed and an imperforate central portion of a fourth thickness less than said third thickness.

2. The closure set forth in claim 1 wherein said first portions of said internal lugs on said outer shell and said external lugs on said inner shell have opposed rounded axially facing surfaces such that said first portions of said internal lugs on said outer shell cannot rest on said external lugs on said inner shell upon application of force to said outer shell.

3. The closure set forth in claim 1 wherein said second portions of said internal lugs on said outer shell have rounded radially inwardly facing surfaces for sliding contact with an outer surface of said peripheral skirt of said inner shell.

4. A child-resistant closure that includes:

an plastic inner shell having a base wall, a peripheral skirt with at least one internal thread segment and an angularly spaced circumferential array of external lugs on said base wall, and a plastic outer shell having a base wall, a peripheral skirt and an angularly spaced circumferential array of internal lugs on said base wall, said inner shell being received within said outer shell such that said internal lugs on said base wall of said outer shell are disposed for engagement with said external lugs on said base wall of said inner shell to apply or remove said closure to or from a container neck finish, wherein said internal lugs on said outer shell and said external lugs on said inner shell have opposed rounded axially facing surfaces such that said internal lugs on said outer shell cannot rest on said external lugs on said inner shell upon application of force to said outer shell, wherein said internal lugs on said outer shell are L-shaped and have portions that extend axially along an inside surface of peripheral skirt of said outer shell, wherein said lug portions have rounded radially inwardly facing surfaces for sliding contact with an outer surface of said peripheral skirt of said inner shell, wherein said base wall of said outer shell has a peripheral portion of a first thickness on which said internal lugs are disposed and an imperforate central portion of a second thickness less than said first thickness, and wherein said base wall of said inner shell has a peripheral portion of a third thickness on which said internal lugs are disposed and an imperforate central portion of a fourth thickness less than said third thickness.

5. The closure set forth in claim 4 wherein at least some of said lugs have abutment faces that are non-aligned with axes of said inner and outer shells.

6. A child-resistant closure that includes:

a plastic outer shell having a base wall with a peripheral skirt and a plurality of internal lugs on said base wall adjacent to said skirt, and a plastic inner shell disposed within said outer shell and having a base wall with a peripheral skirt, at least one internal thread segment on said peripheral skirt and a plurality of external lugs on said base wall adjacent to said skirt, said base wall of said outer shell having a peripheral portion of a first thickness on which said internal lugs are disposed and an imperforate central portion of a second thickness less than said first thickness, said base wall of said inner shell having a peripheral portion of a third thickness on which said external lugs are disposed and an imperforate central portion of a fourth thickness less than said third thickness, wherein said internal lugs on said outer shell are L-shaped, each having a first portion extending radially inwardly along said peripheral portion of said base wall for engaging said external lugs on said inner shell, and a second portion extending axially along an inner surface of said peripheral skirt of said outer shell for slidably engaging said inner shell and aligning said inner shell within said outer shell.

7. The closure set forth in claim 6 wherein said second portions of said internal lugs on said outer shell have rounded radially inwardly facing surfaces for sliding contact with an outer surface of said peripheral skirt of said inner shell.

8. The closure set forth in claim 6 wherein said first portions of said internal lugs on said outer shell and said external lugs on said inner shell have opposed rounded axially facing surfaces such that said first portions of said internal lugs on said outer shell cannot rest upon said external lugs on said inner shell upon application of force to said outer shell.

9. A package that includes a container having a neck finish and a closure as set forth in claim 1, 4 or 6 threaded onto said neck finish.

* * * * *